US006989828B2

(12) United States Patent
Correa et al.

(10) Patent No.: US 6,989,828 B2
(45) Date of Patent: Jan. 24, 2006

(54) METHOD AND APPARATUS FOR POWER LEVEL CONTROL OF A DISPLAY DEVICE

(75) Inventors: Carlos Correa, Villingen-Schwenningen (DE); Sébastien Weitbruch, Mönchweiler (DE); Harald Roth, Mönchweiler (DE)

(73) Assignee: Thomson Licensing S.A., Boulogne-Billancourt (FR)

( * ) Notice: Subject to any disclaimer, the term of this patent is extended or adjusted under 35 U.S.C. 154(b) by 381 days.

(21) Appl. No.: 10/343,290

(22) PCT Filed: Jul. 23, 2001

(86) PCT No.: PCT/EP01/08486

§ 371 (c)(1),
(2), (4) Date: Jan. 28, 2003

(87) PCT Pub. No.: WO02/11111

PCT Pub. Date: Feb. 7, 2002

(65) Prior Publication Data

US 2004/0061695 A1 Apr. 1, 2004

(30) Foreign Application Priority Data

Jul. 28, 2000 (EP) ..... 00250257

(51) Int. Cl.
*G09G 5/00* (2006.01)

(52) U.S. Cl. ..... 345/211; 345/60

(58) Field of Classification Search ..... 345/211, 345/212, 213, 691, 60, 63
See application file for complete search history.

(56) References Cited

U.S. PATENT DOCUMENTS 5,247,288 A * 9/1993 Warren et al. ..... 345/60
5,757,343 A * 5/1998 Nagakubo ..... 345/63
6,369,782 B2 * 4/2002 Shigeta ..... 345/63
6,407,725 B1 * 6/2002 Song ..... 345/60
6,462,721 B2 * 10/2002 Kasahara et al. ..... 345/63
6,535,224 B2 * 3/2003 Kuriyama et al. ..... 345/690
6,674,429 B1 * 1/2004 Correa et al. ..... 345/211

FOREIGN PATENT DOCUMENTS

EP 0829846 A2 3/1998
EP 0841652 A2 3/1998
JP 06259034 9/1994

OTHER PUBLICATIONS

Euorpean Search Report, Mar. 20, 2003.

* cited by examiner

*Primary Examiner*—Kent Chang
(74) *Attorney, Agent, or Firm*—Joseph S. Tripoli; Harvey D. Fried; Sammy S. Henig

(57) ABSTRACT

Plasma Display Panels (PDP) are becoming more and more interesting for TV technology. One important criterion for picture quality is the Peak White Enhancement Factor (PWEF). From a previous patent application of the applicant it is known to have a table of power level modes in a control unit for the display device. The average picture power value is measured and a corresponding power level mode will be selected from the table for sub-field coding. The power level modes have been made variable in respect to a number of parameters, namely:

the number of sub-fields
the sub-field type
the sub-field positioning
the sub-field weight
the sub-field pre-scaling
a factor for the sub-field weights which is used to vary the amount of small pulses generated during each sub-field.

According to the invention it is now proposed to use one or both of the following parameters in addition for varying the power level modes:

the sustain frequency
the sustain pulse slope.

14 Claims, 8 Drawing Sheets

METHOD AND APPARATUS FOR POWER LEVEL CONTROL OF A DISPLAY DEVICE

This application claims the benefit under 35 U.S.C. § 365 of International Application PCT/EP01/08486, filed Jul. 23, 2001, which claims the benefit of European Patent Application No. 00250257.3, filed Jul. 28, 2000.

The invention relates to a method and apparatus for power level control of a display device.

More specifically the invention is closely related to a kind of video processing for improving the picture quality of pictures which are displayed on displays like plasma display panels (PDP), and all kind of displays based on the principle of duty cycle modulation (pulse width modulation) of light emission.

BACKGROUND

The plasma display technology now makes it possible to achieve flat colour panels of large size and with limited depth without any viewing angle constraints. The size of the displays may be much larger than the classical CRT picture tubes would have ever been allowed.

Referring to the latest generation of European TV sets, a lot of work has been made to improve its picture quality. Consequently, there is a strong demand, that a TV set built in a new technology like the plasma display technology has to provide a picture so good or better than the old standard TV technology.

One important quality criterion for a video picture is the Peak White Enhancement Factor (PWEP). The Peak White Enhancement Factor can be defined as the ratio between the peak white luminance level, to the luminance of a homogeneous white field/frame. CRT based displays have PWEF values of up to 6, but present Plasma Display Panels, (PDP), have PWEF values of about 4 only. Therefore, under this aspect the picture quality of PDPs is not the best and efforts must be taken to improve this situation.

First generations of PDPs were characterised by having a peak-white to maximum average luminance ratio (full-white image) of about 2. This has been improved during the last time to achieve a ratio of 4/5 mostly by using a dynamic control of sub-fields.

The Plasma display technology, being inherently digital, requires some other techniques than what is used for CRTs. CRTs use a so called ABL circuit (average beam-current limiter), which is implemented by analog means usually in the video controller, and which decreases video gain as a function of average luminance, usually measured over an RC stage.

A plasma display panel utilizes a matrix array of discharge cells, which could only be "on" or "off". Also unlike a CRT or LCD in which gray levels are expressed by analog control of the light emission, a PDP controls the gray levels by modulating the number of light pulses per frame (sustain pulses). The eye will integrate this time-modulation over a period corresponding to the eye time response.

Since the video amplitude determines the number of light pulses, occurring at a given frequency, more amplitude means more eye pulses and thus more "on" time. For this reason this kind of modulation is known as PWM, pulse width modulation. To establish a concept for this PWM, each frame will be decomposed in sub-periods called "sub-fields". For producing the small light pulses, an electrical discharge will appear in a gas filled cell, called plasma and the produced UV radiation will excite a coloured phosphor, which emits the light.

In order to select which cell should be lighted, a first selected operation called "addressing" will create a charge in the cell to be lighted. Each plasma cell can be considered as a capacitor, which keeps the charge for a long time. Afterwards, a general operation called "sustaining" applied during the lighting period will accelerate the charges in the cell, produce further charges and excite some of the charges in the cell. Only in the cells addressed during the first selected operation, this excitation of charges takes place and UV radiation is generated when the excited charges go back to their neutral state. The UV radiation excites the phosphorous for light emission. The discharge of the cell is made in a very short period and some of the charges in the cell remain. With the next sustain pulse, this charge is utilized again for the generation of UV radiation and the next light pulse will be produced. During the whole sustain period of each specific sub-field, the cell will be lighted in small pulses. At the end, an erase operation will remove all the charges to prepare a new cycle.

More sustain pulses correspond to more peak luminance. More sustain pulses correspond also to a higher power that flows in the PDP. The PDP control can generate more or less sustain pulses as a function of average picture power, i.e., it switches between modes with different power levels depending on the picture content. The increase of the slope of the sustain pulses also correspond (non-linear) with more peak luminance.

The main objective is to optimize the contrast ratio without overstressing the power supply circuitry. In addition, the overall picture quality is linked to the number of sub-fields used for the grayscale rendition. The higher this number is, the better the picture quality is. Nevertheless, each sub-field introduces idle-time (death-time) for which no sustain can be made. When the number of sub-fields increases, the maximal number of available sustain decreases. For that reason, a strong compromise has to be made to optimize the picture luminance.

In a previous European Patent Application of the applicant, see WO 00/46782, a solution is described in which a control method generates more or less sustain pulses as a function of the average picture power, i.e., it switches between different modes with different power levels. This control method is characterized in that a set of power level modes is provided for sub-field coding, wherein to each power level mode a characteristic sub-field organisation belongs, the sub-field organisations being variable in respect to one or more of the following characteristics:

- the number of sub-fields
- the sub-field type
- the sub-field positioning
- the sub-field weight
- the sub-field pre-scaling
- a factor for the sub-field weights which is used to vary the amount of small pulses generated during each sub-field.

INVENTION

It is an object of the invention to further improve the dynamic PWEF control method and apparatus. This object is achieved with the method and apparatus defined in claims 1 and 7.

A more efficient peak white circuit requires a higher number of available discrete power level modes. The number of discrete power levels can be increased if more degrees of freedom are used, i.e., by using a more dynamic control of sub-fields combined with an optimized control of the sustain frequency and/or sustain pulse slope.

With the dynamic control of the sustain frequency in addition to the conventional sub-field parameter variations as listed above a PWEF of 8 or more can be achieved!

The sustain frequency has been kept constant in the past by all plasma display suppliers. This had the additional disadvantage, of allowing only a reduced number of discrete power levels (about 20), and of accepting a low-quality gray scale portrayal. This was due to the fact that it was difficult, for most of the power levels, to distribute, the available discrete number of sustains, among the available number of sub-fields, keeping the relative sub-field weighting correct.

In addition, the use of a hysteresis circuit in the luminance level selection control is needed to ensure perfect picture quality (no pumping or flashing of the panel).

The invention consists further in an apparatus for power level control of a display device. Here, the invention consists of an apparatus that has stored a table of power level modes (17) in a control unit (11) for sub-field coding, wherein a picture power measuring circuit (10) determines a value (PL) which is characteristic for the power level of a video picture and the control unit (11) selects a corresponding power level mode for sub-field coding. Upon switching from one power level mode to another the control unit (11) provides sustain pulses for driving the display with one or both of the following characteristics changed compared to the previous power level mode:

the sustain frequency the sustain pulse slope.

Picture having a lot of energy (e.g. full-white page) will be displayed with a lower luminance to reduce the overall power consumption. This luminance will specify the maximal power consumption of the panel. Obviously, when the picture disposes of less energy, more luminance can be produced without overstressing the power supply (same maximal power consumption).

Advantageously, additional embodiments of the inventive method and apparatus are disclosed in the respective dependent patent claims.

DRAWINGS

Exemplary embodiments of the invention are illustrated in the drawings and explained in more detail in the following description.

EXEMPLARY EMBODIMENTS

Figure 1:
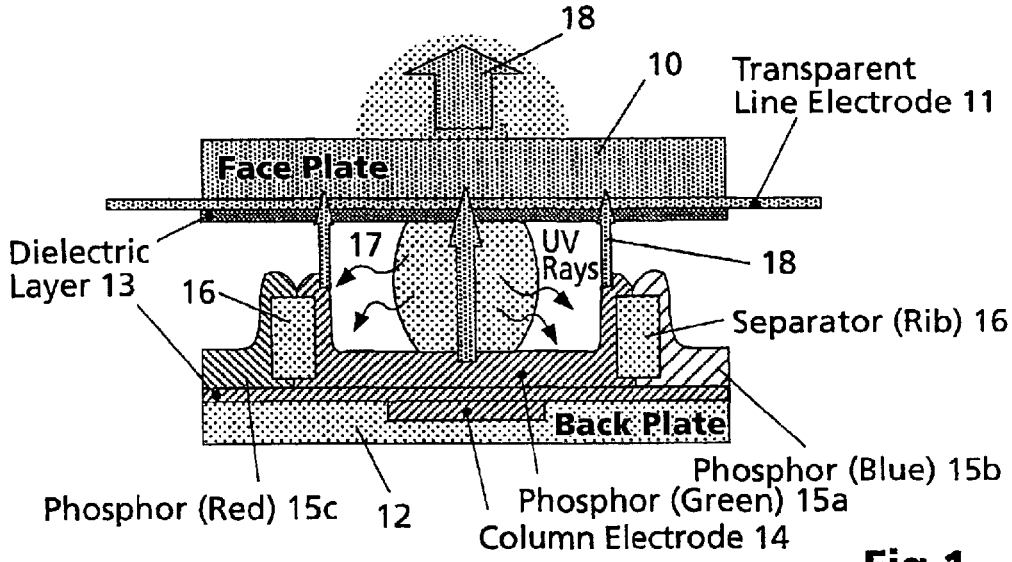
FIG. 1 shows the cell structure of the plasma display panel in the matrix technology.

The principle structure of a plasma cell in the so-called matrix plasma display technology is shown in FIG. 1.

Reference number 10 denotes a face plate made of glass. With reference number 11 a transparent line electrode is denoted. The back plate of the panel is referenced with reference number 12. There are two dielectric layers 13 for isolating face and back plate against each other. In the back plate are integrated colour electrodes 14 being perpendicular to the line electrodes 11. The inner part of the cells consists of a luminous substance 15 (phosphorous) and separators 16 for separating the different coloured luminescent materials (green 15A) (blue 15B) (red 15C). The UV radiation caused by the discharge is denoted with reference number 17. The light emitted from the green phosphorous 15A is indicated with an arrow having the reference number 18. From this structure of a PDP cell it is clear, that there are three plasma cells necessary, corresponding to the three colour components RGB to produce the colour of a picture element (pixel) of the displayed picture.

The gray level of each R, G, B component of a pixel is controlled in a PDP by modulating the number of light pulses per frame period. The eye will integrate this time modulation over a period corresponding to the human eye response. The most efficient addressing scheme should be to address n times if the number of video levels to be created is equal to n. In case of the commonly used 8 Bit representation of the video levels, a plasma cell should be addressed 256 times according to this. But this is not technically possible since each addressing operation requires a lot of time (around 2 $\mu$s per line>960 $\mu$s for one addressing period>245 ms) for all 256 addressing operations, which is more than the 20 ms available time period for 50 Hz video frames.

Figure 2:
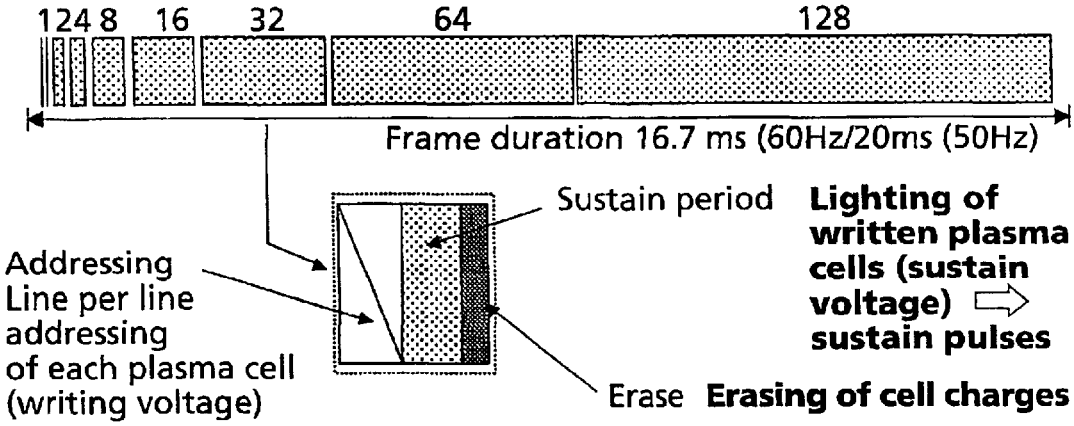
FIG. 2 shows the conventional ADS addressing scheme during a frame period.

From the literature a different addressing scheme is known which is more practical. According to this addressing scheme a minimum of 8 sub-fields (in case of an a Bit video level data word) are used in a sub-field organization for a frame period. With a combination of these 8 sub-fields it is possible to generate the 256 different video levels. This addressing scheme is illustrated in FIG. 2. In this figure each video level for each colour component will be represented by a combination of 8 bits with the following weights:

1/2/4/8/16/32/64/128

To realize such a coding with the PDP technology, the frame period will be divided in 8 lighting periods (called sub-fields), each one corresponding to a bit in a corresponding sub-field code word. The number of light pulses for the bit "2" is the double as for the bit "1" and so forth. With these 8 sub-periods it is possible, through sub-field combination, to build the 256 gray levels. The standard principle to generate this gray level modulation is based on the ADS (Address/Display Separated) principle, in which all operations are performed at different times on the whole panel. At the bottom of FIG. 2 it is shown that in this addressing scheme each sub-field consists of three parts, namely an addressing period, a sustaining period and an erasing period.

In the ADS addressing scheme all the basic cycles follow one after the other. At first, all cells of the panel will be written (addressed) in one period, afterwards all cells will be lighted (sustained) and at the end all cells will be erased together.

The sub-field organization shown in FIG. 2 is only a simple example and there are very different sub-field organizations known from the literature with e.g. more sub-fields and different sub-field weights. Often, more sub-fields are used to reduce moving artifacts and "priming" could be used on more sub-fields to increase the response fidelity. Priming is a separate optional period, where the cells are charged and erased. This charge can lead to a small discharge, i.e. can create background light, which is in principle unwanted. After the priming period an erase period follows for immediately quenching the charge. This is required for the following sub-field periods, where the cells need to be addressed again. So priming is a period, which facilitates the following addressing periods, i.e. it improves the efficiency of the writing stage by regularly exciting all cells simultaneously.

The addressing period length is equal for all sub-fields, also the erasing period lengths. In the addressing period, the cells are addressed line-wise from line 1 to line n of the display. In the erasing period all the cells will be discharged in parallel in one shot, which does not take as much time as for addressing. The example in FIG. 2, shows that all operations addressing, sustaining and erasing are completely separated in time. At one point in time there is one of these operations active for the whole panel.

Figure 3:
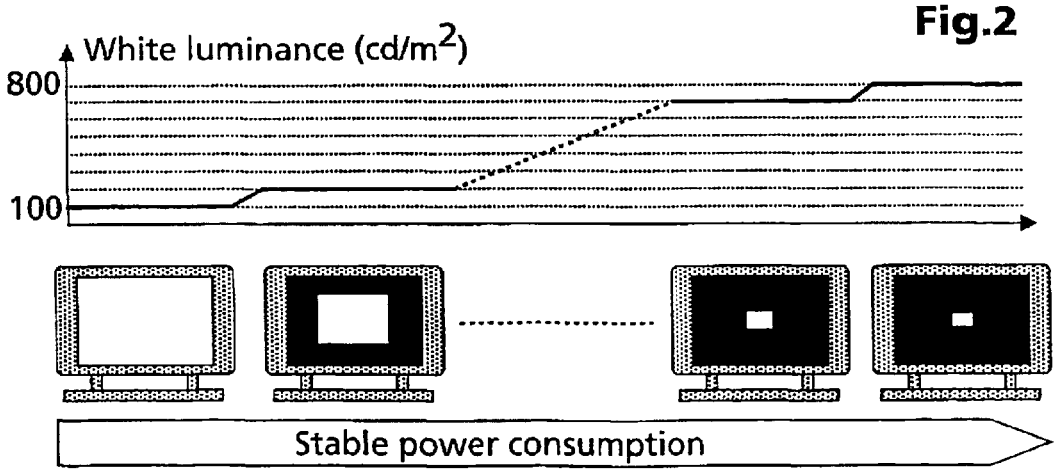
FIG. 3 illustrates the typical power management control system in a PDP.

FIG. 3 shows the principle of the power management in a PDP in the case of a PWEF=8. Depending on the picture load, the quantity of emitted light will be changed in order to let the power consumption remain stable while showing the best contrast ratio. Obviously, when a PDP screen displays a full white picture (left screen in FIG. 3), less luminance is needed by the eye to catch a nice impression of luminance since this luminance is displayed on a very large part of the visual field. On the other hand, when a PDP screen displays a picture having low energy (right screen in FIG. 3) the contrast ratio is very important for the eye. In that case, the highest available white luminance should be output on such a picture to enhance this contrast ratio (ratio between black and white parts of the picture).

This concept will lead to a change in the white luminance depending on the picture content. Nevertheless, in order not to generate new artifacts like pumping (oscillation of the picture luminance) or flashing (strong change of white-luminance which becomes perceptible) a lot of modes have to be defined to enable a smooth transition and their control has to be made through a hysteresis loop.

For that purpose, a power level PL will be computed for each video image and will be used for selecting the current displaying power mode PM. An example of one possible PL computation is given by the formula:

$$PL = \frac{1}{N}\sum_{x,y}(R_{x,y} + G_{x,y} + B_{x,y})$$

in which, $R_{x,y}$ represents the amplitude of the Red component from the pixel located at the position (x,y) and N represents the total number of basic cells (color components, for RGB pictures N=3) contained in the frame.

Figure 4:
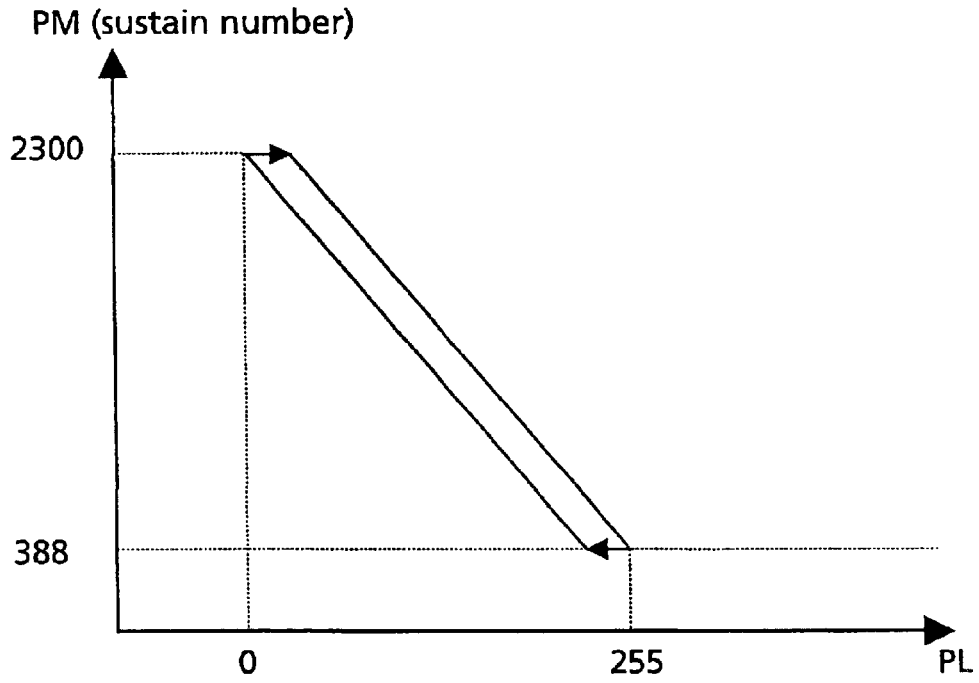
FIG. 4 illustrates a hysteresis curve for the dynamic control of the power level modes.

In FIG. 4 an example of the dynamic control of the power mode selection (PM) depending on the computed power level (PL) using a simple hysteresis function is shown. As it should be expected, when picture power level PL increases, modes are selected with decreasing sustain pulse number. There is a hysteresis loop in the control function. When picture average power is increasing, modes PM with power levels on the top line are chosen. When picture power is decreasing, modes PM with power levels on the bottom line are chosen. Points between the two lines can be chosen when the picture average power growth direction is modified. In addition, for the disclosure of such a power level control method it is expressively referred to above mentioned patent application document WO 00/46782.

The ADS addressing scheme has been described above already. In order to simplify the exposition, some scanning values from one possible implementation will be used as an example. Obviously, some other values could also be used since they depend on the panel technology.

The example will be based on the following scanning values:

One frame contains 5500 basic cycles (BC) at 60 Hz.

The addressing of one sub-field has a duration of 240 basic cycles.

One erasing has a cost of 70 basic cycles.

One priming (needed only at the beginning of each frame) has a cost of 55 basic cycles.

Figure 5:
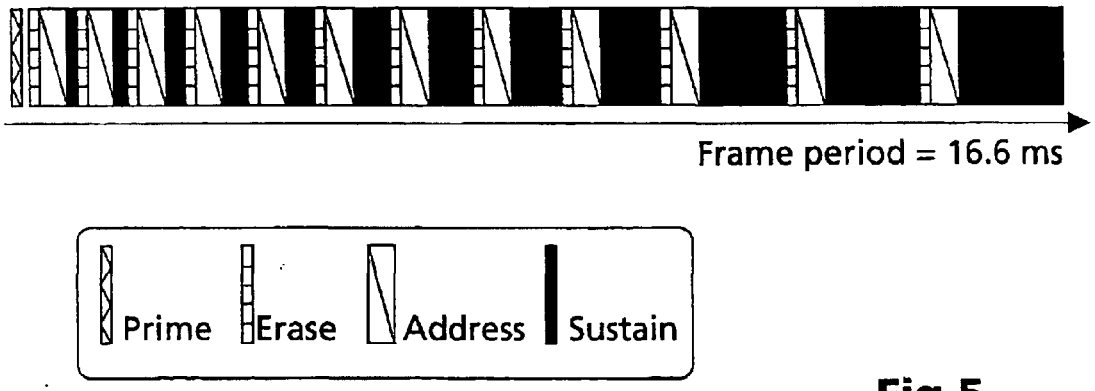
FIG. 5 shows the classical ADS addressing scheme for a PDP inclusive priming.

FIG. 5 illustrates a sub-field organisation based on the ADS addressing scheme with 12 sub-fields and one priming/erase operation at the beginning of a frame period.

The implementation of such a scanning will have the following cost:

Addressing: 12×242=2880 BC

Priming: 55 BC

Erasing: 12×70=840 BC

Consequently, in this example, there will be 5500−2880−55−840=1725 BC free for making sustain pulses. On one hand, if we reduce the number of sub-fields, more basic cycles will be available for making light. On the other hand, if we increase the number of sub-fields, less basic cycles will be available for making light.

In addition, pictures having a lot of energy are very critical in terms motion artifacts and gray-scale portrayal. Therefore, more sub-fields are necessary for these kind of pictures.

All these results will lead to the development of different power level modes based on the change of the sub-field number in the sub-field organisation. The following table presents a possible first definition of a skeleton of Power Level Modes:

TABLE 1

| Modes | Sub-field number | Addressing | Erasing | Free |
|---|---|---|---|---|
| M1 | 15 | 3630 | 1050 | 765 |
| M2 | 14 | 3388 | 980 | 1077 |
| M3 | 13 | 3146 | 910 | 1389 |
| M4 | 12 | 2904 | 840 | 1701 |
| M5 | 11 | 2662 | 770 | 2013 |
| M6 | 10 | 2420 | 700 | 2325 |
| M7 | 9 | 2178 | 630 | 2637 |

The mode M1 will be used for pictures having lot of energy (full-white) and needing the highest picture quality mainly with respect to moving artefacts. When the picture energy decreases, the other modes will be selected step by step. In the table above only seven different modes are set up, which is not enough to ensure a good picture power management since the step between the modes is still high (≈300 BC). In the next paragraph, it will be explained how to refine the rough power level skeleton in the table above in order to define much more modes.

The 7 different modes in the table above can be easily implemented with a technique, which is now well established by different plasma manufacturers, namely the variation of the number of sub-fields in the sub-field organisation for peak white enhancement. In order to better understand the new concept to refine these modes it is advantageous to first explain in more detail the light emission process in a PDP.

All Plasma display technologies are based on a gas discharge. In order to simplify the exposition, the presentation will be concentrated on the alternative current plasma display technologies (AC plasma panels) which are mainly used today. Nevertheless all basic principles described in this document can be also applied to the DC plasma panels.

Figure 6:
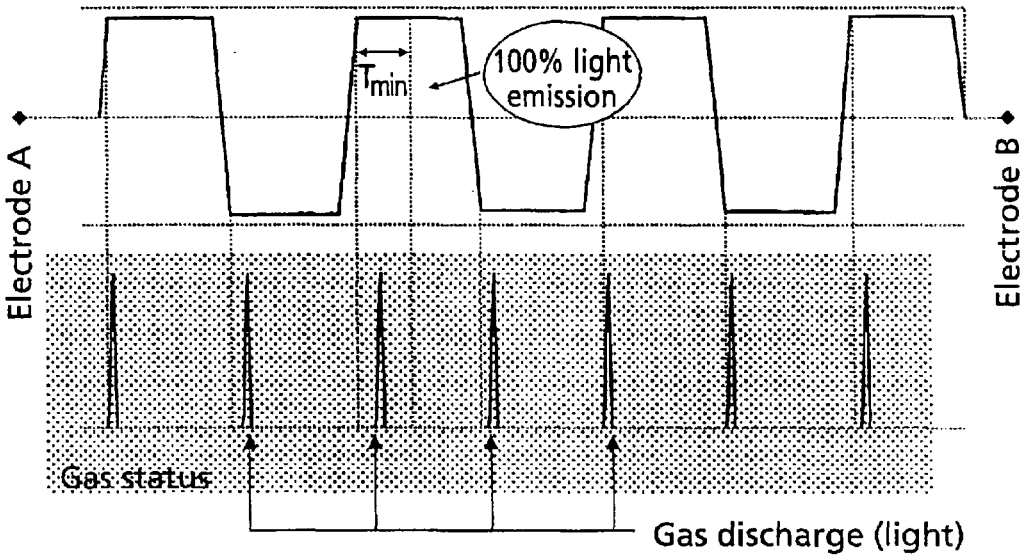
FIG. 6 shows the sustain pulses for driving an AC plasma cell and the corresponding light emission peaks.

In order to produce the gas discharge in an AC plasma display, an alternating square signal will be applied on two electrodes of a panel cell (sustain electrodes in case of the coplanar plasma display panels) in order to produce a light emission (plasma discharge) as shown in FIG. 6. The position of the electrodes per panel cell can change from one display technology to another, but the principle stays always the same. The rectangular sustain pulses are shown in the upper part of FIG. 6. The polarity between the sustain electrodes is periodically switched over with the rectangular sustain pulses. In the lower part of FIG. 6 the gas status in a plasma cell is depicted. Short after the polarity of a sustain pulse has changed, the gas discharge will take place, UV light will be produced, and the luminescent material will be excited to generate a light pulse.

The duration of each sustain pulse determines the quantity of sustain pulses which can be made per frame period depending on the time which stays free for sustaining. This also determines the frequency of the sustain pulses. Generally, there is a minimum of the sustain pulse duration to ensure a good sustain functioning enabling a good panel response fidelity. This minimum time is shown in the upper part of FIG. 6 and is approximately half of a sustain pulse in the drawing. The rest of the sustain duration constitutes a margin which can be used to adjust the sustain frequency to the panel behavior. It is seen in the lower part of FIG. 6 that the gas discharge peaks can vary slightly in time from sustain pulse to sustain pulse. Within time Tmin the gas discharge and the corresponding light emmission will take place with high reliability.

Each panel will have a domain in which its behavior is quite stable. A stable panel behavior can be assured for example with a sustain frequency between 120 kHz and 180 kHz. In is that domain, the light efficacy (lumen/watt) can be considered as the best one for this example. Today, a fixed frequency (e.g. 150 kHz) in this domain is used in order to optimize the energy recovery circuitry that will be explained hereinafter.

AC plasma displays require a special discrete sustain circuit to generate the sustain pulses. Since a PDP cell can be considered as a capacity, the capacitance losses introduced in each cell (½×C×V2) will introduce a strong power dissipation in the sustain circuit just to charge or discharge the panel capacitance. This is unacceptably high for many applications (e.g. full-white loading) and is even greater for larger diagonal panels. Fortunately, more than 90% of this energy can be recovered through the use of an energy recovery circuit like the circuit shown in FIG. 7. The plasma cells of the panel in summary can be regarded as a capacitor $C_p$ that needs to be charged and discharged for light generation. A corresponding capacitor $C_{ss}$ is provided in the energy recovery circuit of the upper part of FIG. 7 for storing the charge of the panel capacity during discharge. Two diodes D1 and D2 can be switched in the charge and discharge path of the cell capcity $C_p$ by means of controllable switches S1 and S2. An inductor L is also in the charge and dsicharge path of the energy recovery circuit. Inductor L and capacitor $C_p$ have a specific resonant frequency that is optimized for the periodical charge and discharge process. The supply voltage $V_{cc}$ and Ground is connected to the charge and discharge path via controllable switches S3 an S4. These are used to compensate the inevitable losses in the charge and discharge phases. In the lower part of FIG. 7 it is illustrated how the positive polarity sustain pulse is generated with the sustain driver circuit shown in the left part of the upper part of FIG. 7. The voltage drop over the capacitor $C_p$ and the current flow in and out of the capacitor $C_p$ are separately displayed. A controller switches the switches S1 to S4 as depicted in the 4 phases ① to ④.

A corresponding sustain driver is provided on the right side of the panel (not shown in detail). For more details regarding this circuit it is referred to the literature, where this energy recovery circuit is known since long.

The fundamental principle is to charge and discharge the panel capacitance through an inductor L instead of through the lossy resistance of a switch. The basic shape of the sustain waveform is still a square pulse, however the rising and falling edges of the square pulses appear as sine wave segments having a resonant frequency determined by the inductor L and the panel capacitance $C_p$. As already said, this circuit is optimized for a selected sustain frequency in the PDPs today.

In order to dispose of more power modes using the same skeleton as presented in the table above, the length of the sustain pulses will be changed according to the invention which will enable, at the same time, to produce more or less sustain pulses. Obviously, it is necessary to take care not to reduce the duration of the sustain pulses below the limit $T_{min}$.

In addition, care should be taken to stay in a sustain frequency domain with a stable panel behavior (same efficacy) to ensure the definition of linear modes. In the present example, this means to stay in a sustain frequency domain between 120 kHz and 180 kHz.

This will also need to modify a bit the energy recovery circuit to optimize it no more for a fixed sustain frequency (former 150 kHz) but for the complete domain 120 kHz–180 kHz. one staightforward solution is e.g. to use more different inductors in the circuit that are used for different frequencies and corresponding selectors.

Now, the new concept is illustrated with the help of an example making the following assumptions: One basic cycle BC corresponds to 150 clock periods. At 150 kHz, one sustain cycle (positive and negative sustain pulse) corresponds to 300 clock periods.

Figure 8:
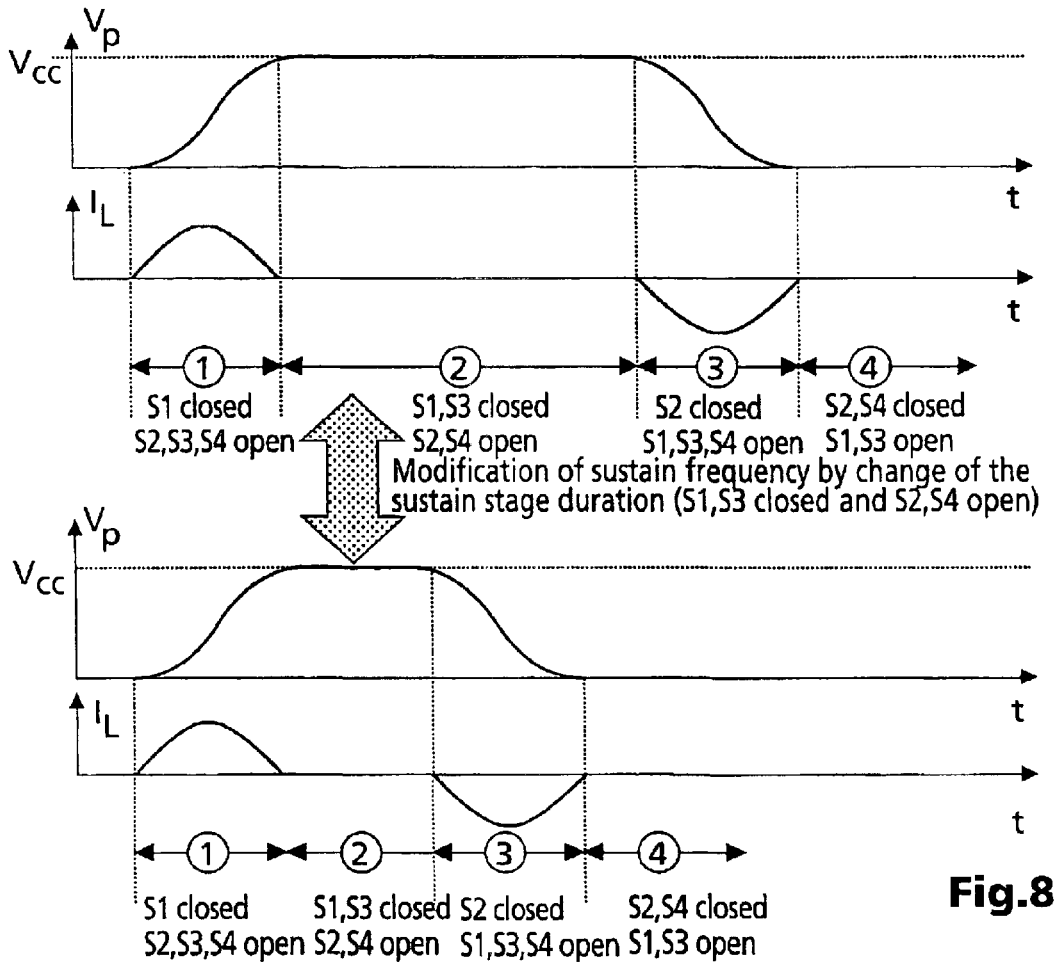
FIG. 8 shows an example of a sustain frequency change by means of a modification of the opening and closing times of the controllable switches in the energy recovery circuit of FIG. 7.

It is now possible to refine the skeleton of power level modes in the table above by adding new sub-modes through a change of the sustain frequency. The controlling of the sustain frequency is shown in FIG. 8. Phase ② will either be prolonged for a sustain frequency reduction or shortened for a sustain frequency increase as shown. This can simply be done by the controller which controls the switches S1 to S4.

In table 2, the resulting new power level modes are listed. As it can be seen from table 2, the available sustain number increases gradually and linearly from 338 (M1.1) up to 1576 (M7.18). These different modes have been derived from the basic modes in table 1 by playing with the sustain duration (measured in clock periods) in order to refine the steps between the modes.

Since a good panel linearity is requested for all the modes, it should be assured that the sustain frequency stays in the domain [120;180].

TABLE 2

| No | Modes | SF number | Free | Sustain freq. | Sustain duration | Sustain number |
|---|---|---|---|---|---|---|
| 1 | M1.1 | 15 | 765 | 132 | 340 | 338 |
| 2 | M1.2 | 15 | 765 | 144 | 312 | 368 |
| 3 | M1.3 | 15 | 765 | 156 | 268 | 398 |
| 4 | M1.4 | 15 | 765 | 168 | 368 | 428 |
| 5 | M2.1 | 14 | 1077 | 127 | 353 | 458 |
| 6 | M2.2 | 14 | 1077 | 136 | 331 | 488 |
| 7 | M2.3 | 14 | 1077 | 145 | 311 | 519 |
| 8 | M2.4 | 14 | 1077 | 153 | 294 | 549 |
| 9 | M3.1 | 13 | 1389 | 125 | 360 | 579 |
| 10 | M3.4 | 13 | 1369 | 132 | 342 | 609 |
| 11 | M3.2 | 13 | 1389 | 138 | 326 | 639 |
| 12 | M3.3 | 13 | 1389 | 144 | 312 | 668 |
| 13 | M4.1 | 12 | 1701 | 123 | 365 | 699 |
| 14 | M4.2 | 12 | 1701 | 129 | 350 | 729 |
| 15 | M4.3 | 12 | 1701 | 134 | 336 | 759 |
| 16 | M4.4 | 12 | 1701 | 139 | 323 | 790 |
| 17 | M5.1 | 11 | 2013 | 122 | 368 | 821 |
| 18 | M5.2 | 11 | 2013 | 127 | 355 | 851 |
| 19 | M5.3 | 11 | 2013 | 131 | 343 | 880 |
| 20 | M5.4 | 11 | 2013 | 136 | 332 | 909 |
| 21 | M6.1 | 10 | 2325 | 121 | 372 | 938 |
| 22 | M6.2 | 10 | 2325 | 125 | 360 | 969 |
| 23 | M6.3 | 10 | 2325 | 129 | 349 | 999 |
| 24 | M6.4 | 10 | 2325 | 133 | 339 | 1029 |
| 25 | M7.1 | 9 | 2637 | 121 | 373 | 1060 |
| 26 | M7.2 | 9 | 2637 | 124 | 363 | 1090 |
| 27 | M7.3 | 9 | 2637 | 127 | 353 | 1121 |
| 28 | M7.4 | 9 | 2627 | 131 | 344 | 1150 |
| 29 | M7.5 | 9 | 2637 | 134 | 335 | 1181 |
| 30 | M7.6 | 9 | 2637 | 138 | 327 | 1210 |
| 31 | M7.7 | 9 | 2637 | 141 | 319 | 1240 |
| 32 | M7.8 | 9 | 2637 | 145 | 311 | 1272 |
| 33 | M7.9 | 9 | 2637 | 148 | 304 | 1301 |
| 34 | M7.10 | 9 | 2637 | 152 | 297 | 1332 |
| 35 | M7.11 | 9 | 2637 | 155 | 290 | 1364 |
| 36 | M7.12 | 9 | 2637 | 158 | 284 | 1393 |
| 37 | M7.13 | 9 | 2637 | 162 | 278 | 1423 |
| 38 | M7.14 | 9 | 2637 | 165 | 272 | 1454 |
| 39 | M7.15 | 9 | 2637 | 169 | 266 | 1487 |
| 40 | M7.16 | 9 | 2637 | 172 | 261 | 1516 |
| 41 | M7.17 | 9 | 2637 | 176 | 256 | 1545 |
| 42 | M7.18 | 9 | 2637 | 179 | 251 | 1576 |

In this example, the lowest sustain frequency is 121 kHz and the highest is 179 kHz . In addition, it is evident from table 2 that more sub-modes have been defined for the basic mode with 9 sub-fields since here a lot of time is available for making sustain pulses and thus all frequencies between 120 kHz and 180 kHz can really be utilized.

In the previous paragraphs, it has been explained that the use of the sustain frequency modification inside a domain in which, the panel behavior stays stable, enables the refining of power level modes. This costs an adapted energy recovery circuit to follow this new constraints.

If one wants to further improve the contrast of the panel for pictures having low energy video content (peak-white pictures), the following should be respected. For such pictures, the loading of the panel is very low and that means the energy recovery circuit does not need to be completely optimized for such modes. In addition, for such modes, we can afford to have a bit less panel efficacy and linearity. For all these reasons, it is acceptable to further increase the sustain frequency (reduce the sustain duration) to define more power level modes. The only limitation is to leave the sustain duration longer than $T_{min}$ to ensure a good panel response fidelity (100% lighting).

TABLE 3

| No | Modes | SF number | Free | Sustain freq. | Sustain duration | Sustain number |
|---|---|---|---|---|---|---|
| 43 | M8.1 | 9 | 2637 | 183 | 246 | 1608 |
| 44 | M8.2 | 9 | 2637 | 187 | 241 | 1641 |
| 45 | M8.3 | 9 | 2637 | 190 | 237 | 1669 |
| 46 | M8.4 | 9 | 2637 | 193 | 233 | 1698 |
| 47 | M8.5 | 9 | 2637 | 197 | 229 | 1727 |
| 48 | M8.6 | 9 | 2637 | 200 | 225 | 1758 |
| 49 | M8.7 | 9 | 2637 | 204 | 221 | 1790 |
| 50 | M8.8 | 9 | 2637 | 207 | 217 | 1823 |
| 51 | M8.9 | 9 | 2637 | 211 | 213 | 1857 |
| 52 | M8.10 | 9 | 2637 | 215 | 209 | 1893 |
| 53 | M8.11 | 9 | 2637 | 220 | 205 | 1930 |
| 54 | M8.12 | 9 | 2637 | 224 | 201 | 1968 |

TABLE 3-continued

| No | Modes | SF number | Free | Sustain freq. | Sustain duration | Sustain number |
|---|---|---|---|---|---|---|
| 55 | M8.13 | 9 | 2637 | 227 | 198 | 1998 |
| 56 | M8.14 | 9 | 2637 | 231 | 195 | 2028 |
| 57 | M8.15 | 9 | 2637 | 234 | 192 | 2060 |
| 58 | M8.16 | 9 | 2637 | 238 | 189 | 2093 |
| 59 | M8.17 | 9 | 2637 | 242 | 186 | 2127 |
| 60 | M8.18 | 9 | 2637 | 246 | 183 | 2161 |
| 61 | M8.19 | 9 | 2637 | 250 | 180 | 2198 |
| 62 | M8.20 | 9 | 2637 | 254 | 177 | 2235 |
| 63 | M8.21 | 9 | 2637 | 259 | 174 | 2273 |
| 64 | M8.22 | 9 | 2637 | 262 | 172 | 2300 |

The previous table 3 lists the additional power level modes added by this proposal under the assumption that the limit $T_{min}$ is equivalent to a maximal frequency of 265 kHz.

As it can be seen from table 3, 22 new modes have been added with an available sustain number increasing gradually and linearly from 1608 (M8.1) up to 2300 (M8.22). The sustain frequency is increasing from 183 kHz up to 262 kHz.

Figure 9:
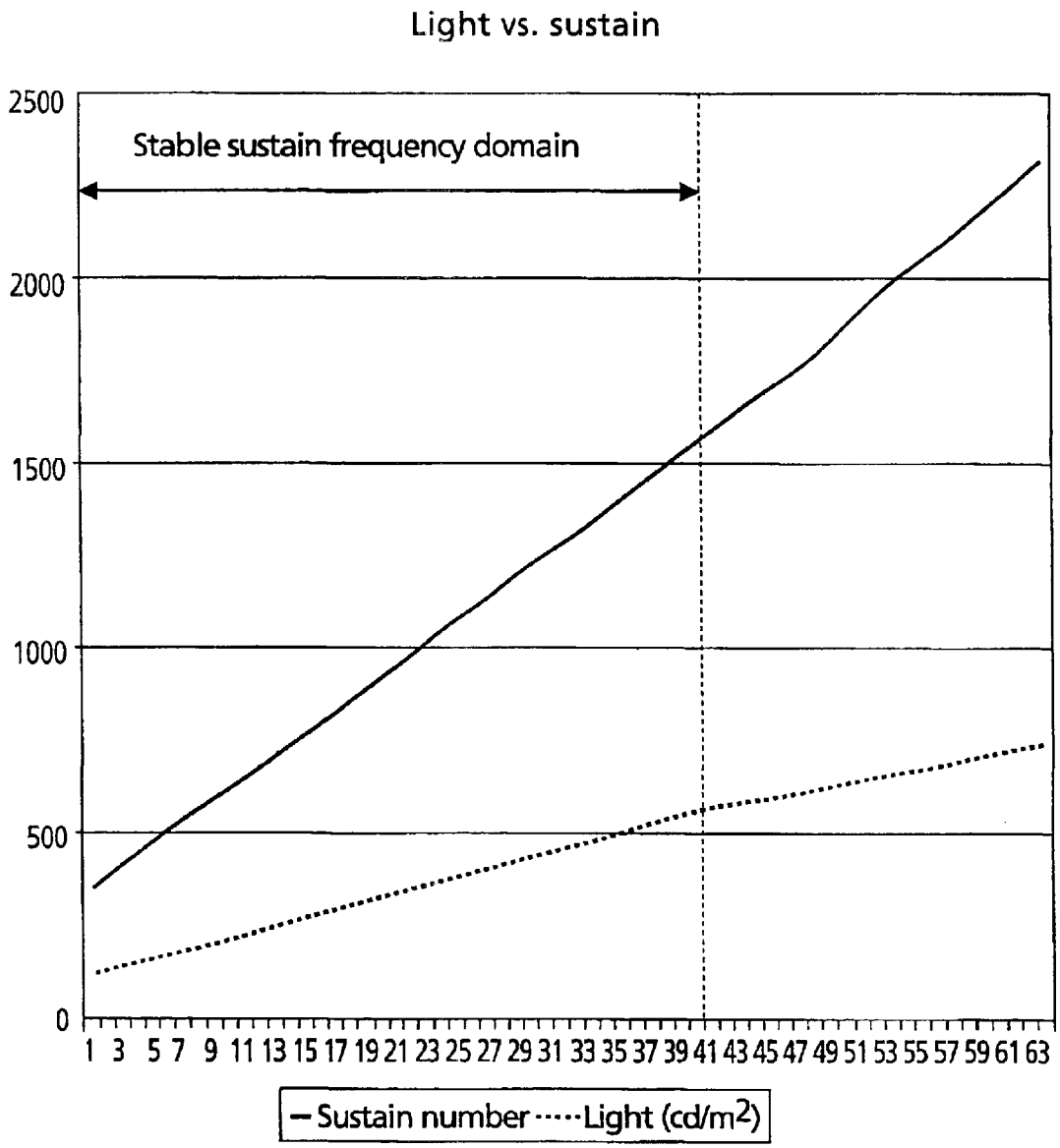
FIG. 9 shows the evolution of the sustain frequency in the different power level modes in comparison to the evolution of the light emission.

FIG. 9 shows the evolution of the sustain number (upper curve) for all 64 modes compared to the evolution of the luminance (cd/m$^2$) (lower curve). At the abzissa the mode number is shown and at the ordinate the sustain number is shown respectively the luminance. FIG. 9 shows an example of one investigated PDP behavior. In this graphic, it can be seen that outside the domain of stable frequency behavior, the light efficacy of the panel decreases a bit and there is a small positive deviation from linearity for the sustain number evolution curve but this still fits in the concept of power management. This is only an example, and with a different panel technology, the behavior can be different outside the stable area.

In the previous paragraphs, we have seen that the variation of the sustain frequency can enable the definition of a lot of power modes. The mode has to be chosen depending on the power level PL measured in the picture.

The power of the picture is measured based on the 8 bit numbers of the RGB values of the pixels in the picture following the formula that was already presented above:

$$PL = \frac{1}{N}\sum_{x,y}(R_{x,y} + G_{x,y} + B_{x,y}).$$

From this formula it is evident that the PL value can also be represented by an 8 bit number. Now, depending on the measured PL value a mode has to be selected. The power level will be selected under the constraint that never the maximum power consumption of the power supply will be exceeded. For this it needs to be defined what the maximum power consumption of the panel is. Of course, the maximum power consumption is in case that the full panel displays a full-white page. This full-white page has assigned a PL=255.

Now, let us assume that, in our example, we want to display this picture with the 338 sustain pulses and a luminance of 121 cd/m$^2$ corresponding to the mode M1.1 of table 2. This is the mode having the highest sub-field number 15 and the lowest sustain pulse number. In that case, the consumption of the panel is proportional to the size of the panel and to the square of the sustain pulse number: $P_{max}=k\cdot 852\cdot 480\cdot 338^2$ with the assumption that the PDP size is 852 pixel times 480 lines. This will specify the maximal energy which flows in the power supply which has to be specified accordingly. Now, for all 255 possible PL, a mode has to be defined which has to respect the maximal power consumption of the panel. This mode can be defined with a formula giving a relation between the measured level PL and the desired sustain number $N_{SUS}$. An example of such a function is given in the following formula:

$$N_{sus} = \frac{\sqrt{255}}{\sqrt{PL}} \times 338.$$

Some other functions of similar type can alternatively be used.

The power level mode selection process will be made more transparent by means of the example: PL=56⇨$N_{sus}$=718. There is no mode in table 2 which exactly represents this sustain number. In order not to overstress the power supply, a possibility will be to choose one mode giving a bit more sustain numbers (M4.2 with $N_{sus}$=729) and to slightly modify the energy located in the picture by applying a corrective factor (pre-scaling function) to the picture content. In our example, the corrective factor will be 718/729=0.98 and the complete picture will be corrected as following:

$$\tilde{R}_{x,y}=0.98\times R_{x,y}$$

$$\tilde{G}_{x,y}=0.98\times G_{x,y}$$

$$\tilde{B}_{x,y}=0.98\times B_{x,y}$$

in which $\tilde{R}_{x,y}$ represents the displayed value of the red component and $R_{x,y}$ all original red values.

With this pre-scaling function, it is therefore easily possible to further refine the modes computed before. The values given in this document should be taken only as an example.

In the previous paragraph, it was explained how a correcting factor can help to refine the different power level modes. Obviously, it is also possible to directly compute the desired power level modes without using a pre-scaling function. In that case, depending on the number of available power levels PL, a table of power mode scan is directly computed.

An example is shown in table 4 with the following assumptions:

A full-white picture should be displayed with 338 sustain pulses.

The relation between the sustain pulse number and the measured PL value is given by the formula:

$$N_{sus} = \frac{\sqrt{255}}{\sqrt{PL}} \times 338.$$

Table 4 presents an example of what such a mode definition could look like (only a few PL levels have been illustrated to reduce the size of the table and the values not shown can easily be derived with the formula given above).

In this table the sustain frequency is the frequency of the sustain cycle. Also the sustain duration is the duration of a full sustain cycle. Further, the sustain number is the number of sustain cycles, not the number of light pulses.

The values in the table are calculated in the following manner. In a first step the sustain number to a given power level value PL is calculated according to the formula above.

TABLE 4

| PL | SF number | Free | Sustain freq. | Sustain duration | Sustain number |
|---|---|---|---|---|---|
| 255 | 15 | 765 | 132 | 340 | 338 |
| 245 | 15 | 765 | 135 | 334 | 344 |
| 235 | 15 | 765 | 138 | 326 | 352 |
| 225 | 15 | 765 | 141 | 320 | 359 |
| 215 | 15 | 765 | 144 | 312 | 368 |
| 205 | 15 | 765 | 148 | 305 | 376 |
| 195 | 15 | 765 | 152 | 297 | 386 |
| 185 | 15 | 765 | 155 | 290 | 396 |
| 175 | 15 | 765 | 160 | 281 | 408 |
| 165 | 15 | 765 | 165 | 273 | 420 |
| 155 | 15 | 765 | 170 | 265 | 433 |
| 145 | 15 | 765 | 176 | 256 | 448 |
| 135 | 14 | 1077 | 129 | 348 | 464 |
| 125 | 14 | 1077 | 134 | 335 | 482 |
| 115 | 14 | 1077 | 140 | 321 | 503 |
| 105 | 14 | 1077 | 147 | 307 | 526 |
| 100 | 14 | 1077 | 150 | 300 | 539 |
| 95 | 14 | 1077 | 154 | 292 | 553 |
| 90 | 14 | 1077 | 158 | 285 | 567 |
| 85 | 14 | 1077 | 163 | 276 | 585 |
| 80 | 14 | 1077 | 168 | 268 | 603 |
| 75 | 14 | 1077 | 174 | 259 | 624 |
| 70 | 13 | 1389 | 139 | 323 | 645 |
| 65 | 13 | 1389 | 145 | 311 | 670 |
| 60 | 13 | 1389 | 151 | 299 | 697 |
| 55 | 13 | 1389 | 157 | 286 | 728 |
| 50 | 13 | 1389 | 165 | 273 | 763 |
| 45 | 13 | 1389 | 174 | 259 | 804 |
| 40 | 12 | 1701 | 151 | 299 | 853 |
| 35 | 12 | 1701 | 161 | 280 | 911 |
| 30 | 12 | 1701 | 174 | 259 | 985 |
| 25 | 11 | 2013 | 161 | 280 | 1078 |
| 20 | 11 | 2013 | 180 | 250 | 1206 |
| 15 | 10 | 2013 | 180 | 250 | 1395 |
| 14 | 9 | 2325 | 164 | 274 | 1444 |
| 13 | 9 | 2637 | 170 | 264 | 1498 |
| 12 | 9 | 2637 | 177 | 254 | 1557 |
| 11 | 9 | 2637 | 185 | 243 | 1628 |
| 10 | 9 | 2637 | 194 | 232 | 1705 |
| 9 | 9 | 2637 | 205 | 220 | 1798 |
| 8 | 9 | 2637 | 217 | 207 | 1911 |
| 7 | 9 | 2637 | 232 | 194 | 2039 |
| 6 | 9 | 2637 | 250 | 180 | 2198 |
| 5 | 9 | 2637 | 265 | 170 | 2327 |

In the next step it is checked whether or not the resulting sustain frequency according to the free number of basic cycles for the current basic mode is in the allowed range between 120 and 180 kHz. If not, the next basic mode with the next lower sub-field number is used. The grey cells in table 4 represent the modes outside the panel linearity (in our example) and outside the allowed sustain frequency range. This previous table is an example and different values or functions can result for a different panel model.

Figure 10:
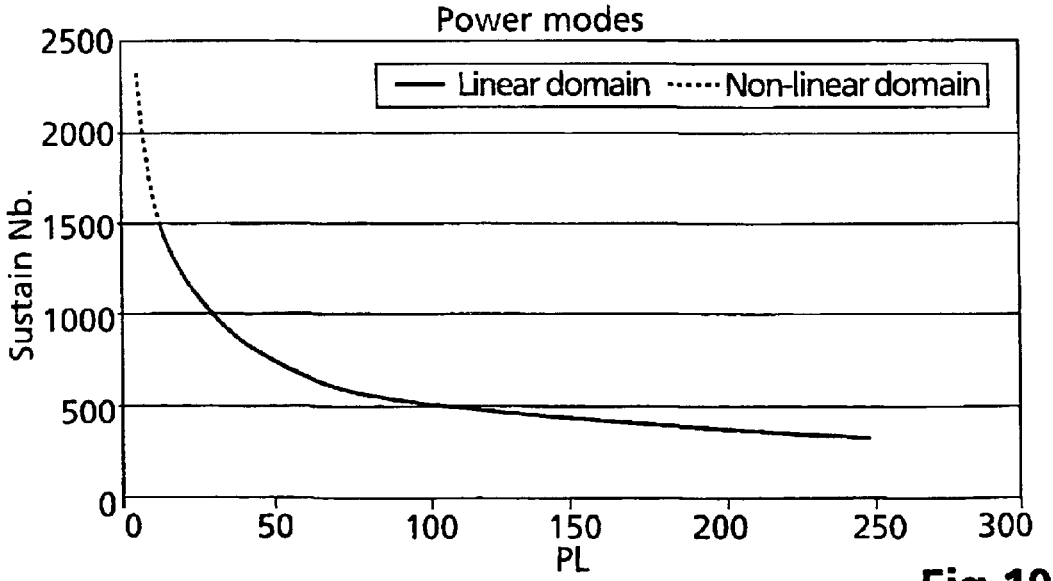
FIG. 10 shows the evolution of the sustain number with the measured picture power level.

FIG. 10 illustrates the evolution of the sustain number depending on the measured Power Level PL.

In the example of table 4, there are no specific modes planned for the PL values below 5 since the sustain frequency has already been increased up to the limit of 265 kHz which corresponds to the upper limit (corresponding to time $T_{min}$) for this example. Nevertheless, this value is only an example and will depend on the panel technology.

In order to go further in the field of peak luminance enhancement, there is another potential for further enhancements lying in the possibility to modify the slope of the sustain pulses according to another embodiment of the invention In order to increase the peak-luminance of the plasma display it is possible to increase the slope of the sustain-pulses by earlier switching-on of the controllable switches S3 and S4. In this way the rising and falling edges of a positive sustain pulse will be steepened. If the overall duration of this sustain pulses is kept constant, the phase ② will be prolonged and therefore, the allowable sustain frequency range can be extended because time $T_{min}$ will be respected also in higher sustain frequencies. Measurements have shown that with this method an increase of the peak-luminance of about 20% can be achieved but only for little lighting areas on the PDP screen. The disadvantage is that the crosstalk also increases.

Figure 11:
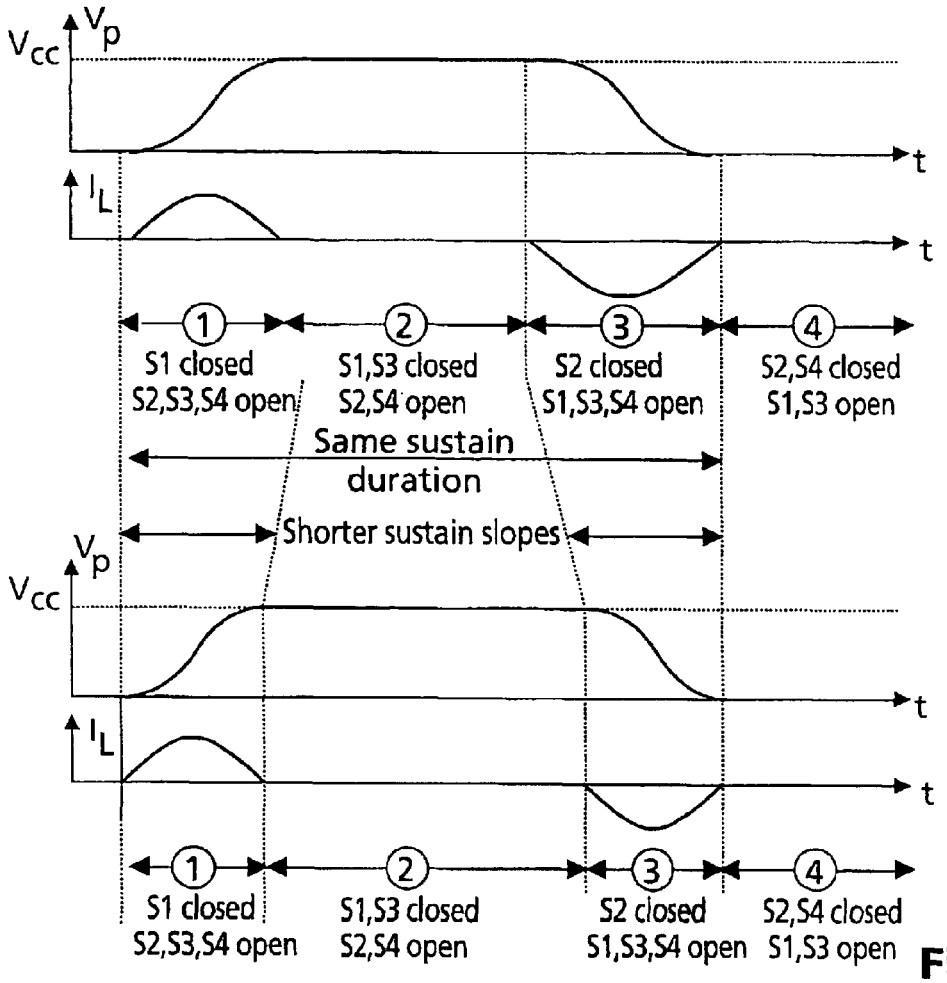
FIG. 11 shows the principle of sustain slope increasing by means of a modification of the opening and closing times of the controllable switches in the energy recovery circuit of FIG. 7.

FIG. 11 illustrates an increase of the sustain slope while staying at the same sustain frequency.

Figure 12:
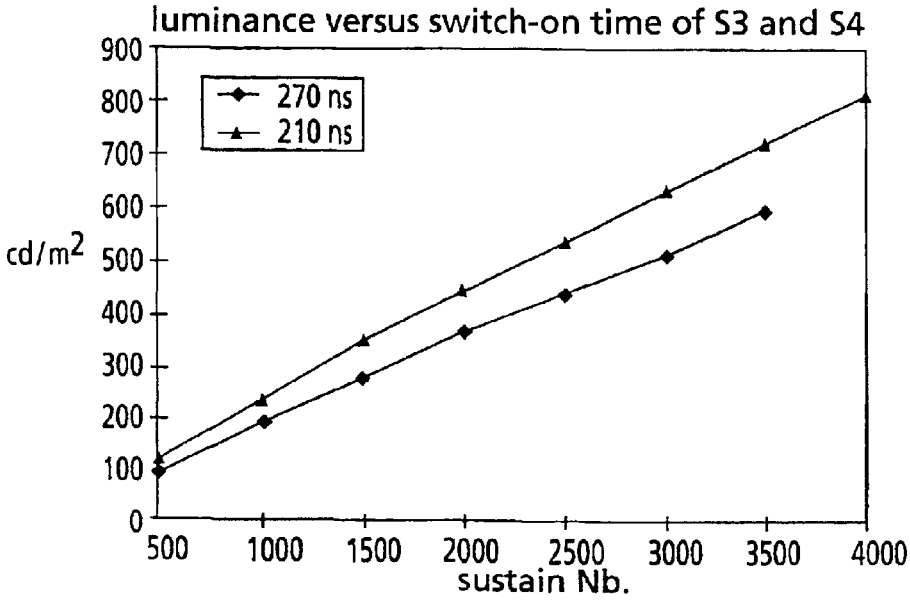
FIG. 12 shows the impact of the sustain slope increasing on the panel luminance.
Figure 13:
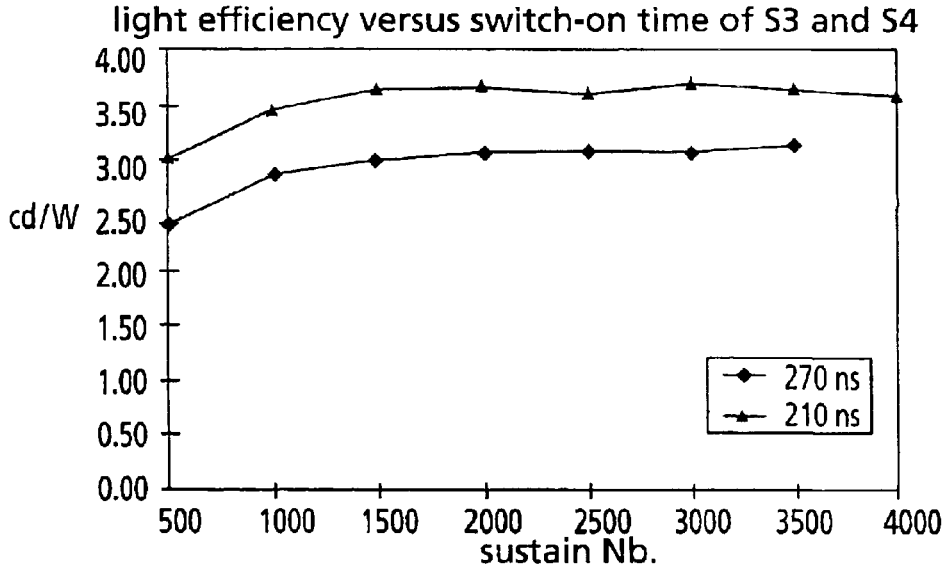
FIG. 13 shows the impact of the sustain slope increasing on the light efficiency.

In FIGS. 12 and 13 the impact of such a sustain slope increasing on the panel luminance is shown. The different curves in the two figures correspond to switching on the switches S3 and S4 after a delay of 270 and 210 ns respectively.

FIG. 12 shows that the luminance produced by the panel for the same number of sustain pulses increases when the sustain slope time decreases from 270 ns to 210 ns (exemplary values). This occurs without any negative effect on the panel efficacy (power consumption per sustain) as illustrated in FIG. 13.

FIG. 13 shows that the modification of the sustain slope from 270 ns to 210 ns has also improved the panel efficiency. That means, as seen in FIG. 12, that the same number of sustain pulses generates more light without more power consumption. In other words the light pulses that are generated per sustain pulse are more intense than without sustain slope increasing. This cannot be used for all modes since it has a negative impact on the picture cross-talk. For that reason, it is proposed to use it preferably only for modes where an extreme high peak-white enhancement is wanted.

The power management concept described in this document is based on the possibility to modify four possible parameters either singly or in combination: the sub-field number, the sustain frequency, the sustain pulse slope and a pre-scaling factor. The modification of the sub-field number and pre-scaling factor has been already presented in WO 00/46782. According to this invention the new parameters that can be varied are the sustain frequency and the sustain pulse slope. These new parameters can be used alone or in parallel, can be combined with one or both of the other parameters (sub-field number or pre-scaling)

Figure 7:
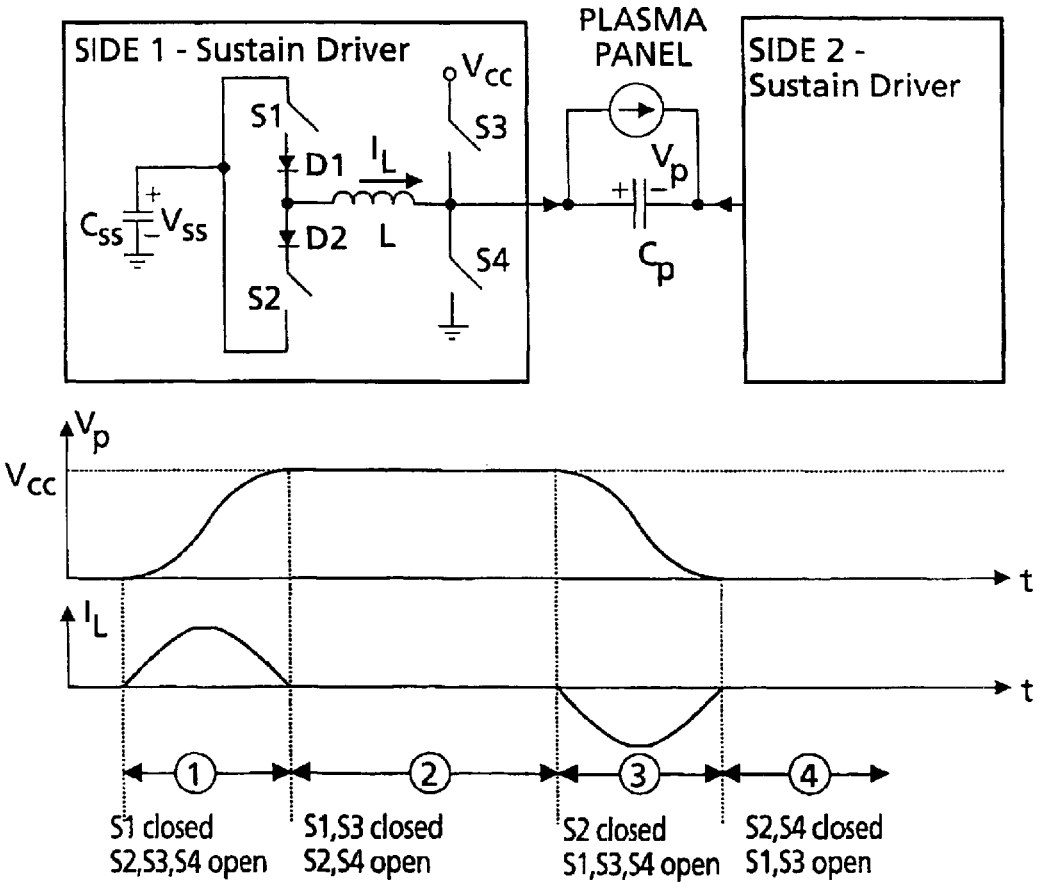
FIG. 7 shows the principle energy recovery circuit of a PDP driving circuit.

For a circuit implementation, two different scenarios will be explained below. The modification of the sustain frequency is made by the controller of the energy recovery circuit. In FIG. 7 showing one possible implementation of an energy recovery circuit, it can be seen that the length of the sustain pulse basically is given by the time in which S1 and S3 are closed, S2 and S4 are open. It is of course possible to leave the system in this status during a longer or shorter time depending on the mode chosen.

Figure 14:
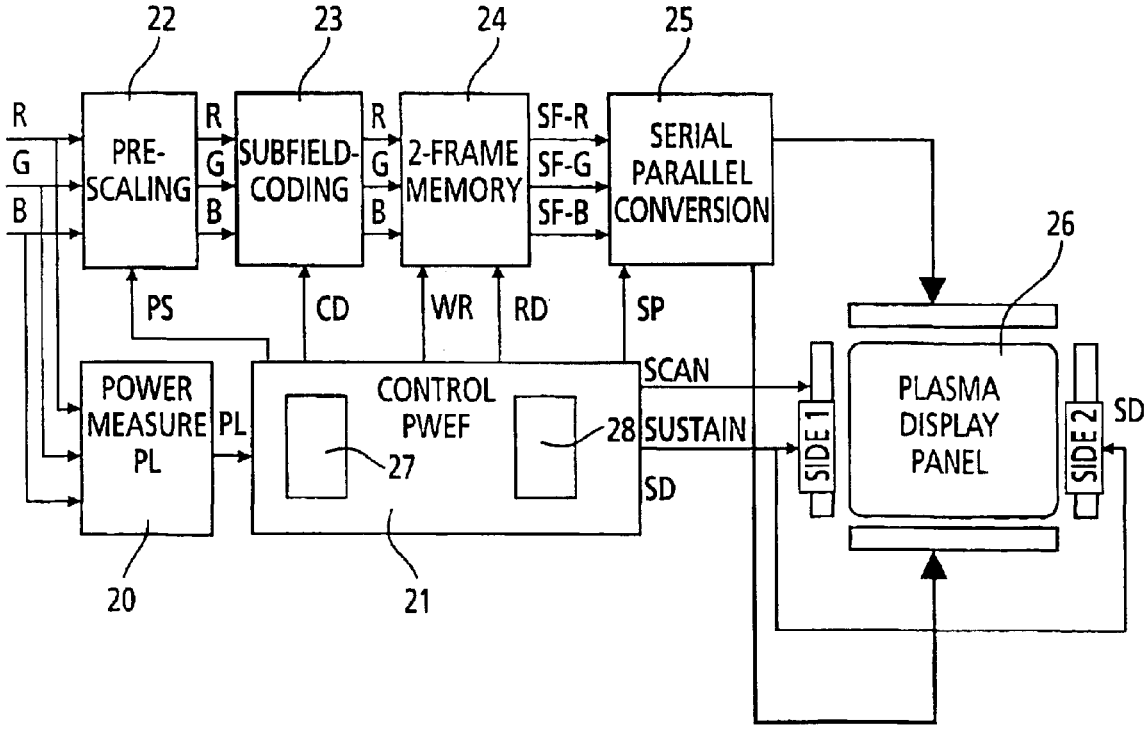
FIG. 14 shows a first example of a circuit implementation of the invention.
Figure 15:
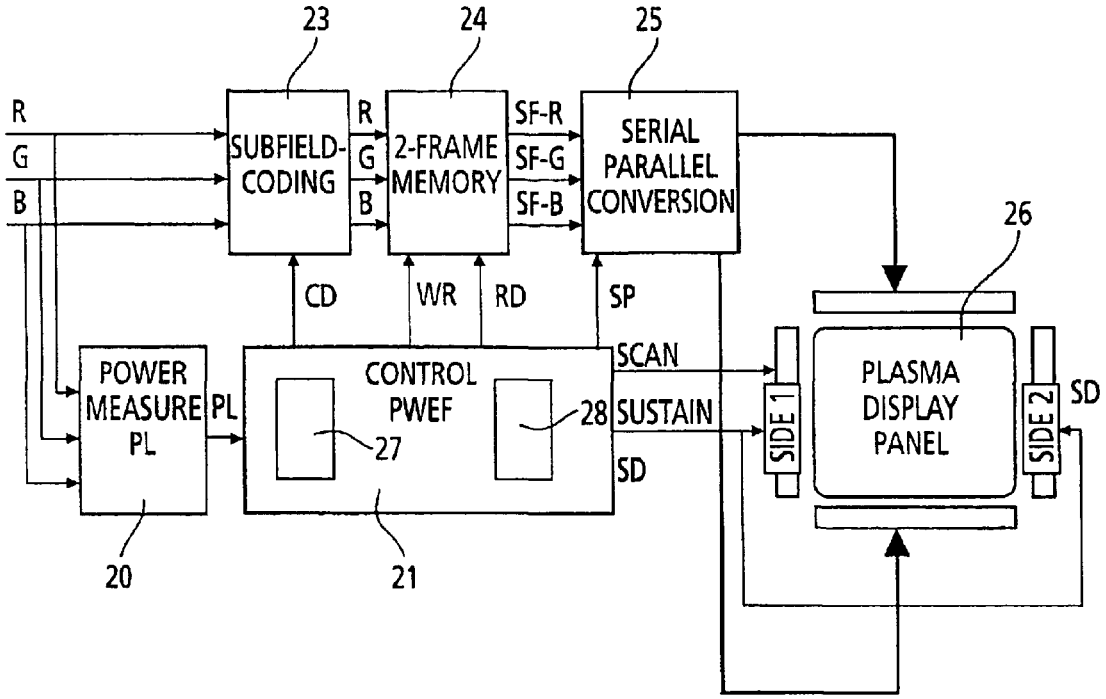
FIG. 15 shows a second example of a circuit implementation of the invention.

The FIGS. 14 and 15 illustrate two possible circuit implementations of the complete system.

In FIG. 14 a block diagram of a circuit implementation for the above explained method is shown. RGB data is analysed in the average power measure block 20 which gives the computed average power value PL to the PWEF control block 21. The average power value of a picture can be calculated by simply summing up the pixel values for all RGB data streams and dividing the result through the number of pixel values multiplied by three. The control block 21, consults its internal power level mode table 27, taking in consideration the previous measured average power value and the stored hysteresis curve 28. It directly generates the selected mode control signals for the other processing blocks. It selects the pre-scaling factor (PS), the sub-field code (CD) to be used and the sustain pulse duration (SD) for the energy recovery circuit.

The sub-field coding parameters (CD) define the number of sub-fields, positioning of the sub-fields, the weights of the sub-fields and the types of the sub-fields as explained in WO 00/46782.

In the pre-scaling unit 22, which receives the pre-scaling factor PS the RGB data words are normalised to the value which is assigned to the selected power level mode as explained above in connection with table 2 and 3.

The sub-field coding process is done in the sub-field coding unit 23. Here, to each normalised pixel value a sub-field code word is assigned. For some values more than one possibility to assign a sub-field code word can be alternatively available. In a simple embodiment there may be a table for each mode so that the assignment is made with this table. Ambiguities can be avoided in this way.

The PWEF control block 21 also controls the writing WR of RGB pixel data in the frame memory 24, the reading RD of RGB sub-field data SF-R, SF-G, SP-B from the second frame memory 24, and the serial to parallel conversion circuit 25 via control line SP. The read bits of the sub-field code words are collected in the serial/parallel conversion unit 25 for a whole line of the PDP. As there are e.g. 854 pixel in one line, this means 2562 sub-field coding Bits need to be read for each line per sub-field period. These bits are input in the shift registers of the serial/parallel conversion unit 25. Finally control block 11 generates the SCAN-, SUSTAIN-, priming, erasing and switching pulses for the sustain pulse generation required to drive the driver circuits for PDP 26.

Note, that an implementation can be made with two frame memories best. Data is written into one frame memory pixel-wise, but read out from the other frame memory sub-field-wise. In order to be able to read the complete first sub-field a whole frame must already be present in the memory. This calls for the need of two whole frame memories. While one frame memory is being used for writing, the other is used for reading, avoiding in this way reading the wrong data.

The described implementation introduces a delay of 1 frame between power measurement and action. Power level is measured, and at the end of a given frame, the average power value becomes available to the controller. At that time it is however too late to take an action, for instance like modifying the sub-field coding, because data has already been written in memory.

For continuously running video this delay does not introduce any problems. However in case of a sequence change, a bright flash may occur. This happens when video changes from a dark sequence to a bright one. This can be a problem for the power supply, which perhaps will not be able to cope with an extreme peak in power.

To handle this problem, the control block can detect that 'wrong' data has been written in memory. The control block will react on that with the output of a blank screen for one frame, or if this is not acceptable, with a strong reduction of the number of sustain pulses for all sub-fields also for the duration of one frame, even at a cost of incurring in rounding mistakes which anyway will not be noticeable for a human viewer. E.g. referring again to the previous example, if the measured average picture power of a picture just written to memory was calculated and the result corresponds to a power level of 460, but a mode with a power level of 1220 has been mistakenly used for sub-field encoding, a coarse correction can be performed, simply by suppressing two thirds of all sustain pulses in all sub-fields.

FIG. 15 represents another possibility to implement the concept without pre-scaling. This will correspond to a direct implementation based on table 4.

Some or all of the electronic components shown in the different blocks may be integrated together with the PDP matrix display. They could also be in a separate box, which is to be connected with the plasma display panel.

The invention can be used in particular in PDPs. Plasma displays are currently used in consumer electronics e.g. for TV sets, and also as a monitor for computers. However, use of the invention is also appropriate for matrix displays, where the light output is also controlled with small pulses in sub-periods, i.e. where the PWM principle is used for controlling the light output.

What is claimed is:

1. Method for power level control in a display device having a plurality of elements corresponding to the colour components of pixels of a picture, wherein the time duration of a video frame or video field is divided into a plurality of sub-fields during which the luminous elements can be activated for light output with small sustain pulses corresponding to a sub-field code word which is used for brightness control, wherein a set of power level modes is provided for sub-field coding, wherein the method includes further the steps of determining a value (PL) which is characteristic for the power level of a video picture and selecting a corresponding power level mode for the sub-field coding, wherein two power level modes differ from each other by one or both of the following parameters:

the sustain frequency the sustain pulse slope.

2. Method according to claim 1, wherein to a power level mode a characteristic sub-field organisation belongs, the sub-field organisations being also variable in respect to one or more of the following parameters:

the number of sub-fields the sub-field type the sub-field positioning the sub-field weight the sub-field pre-scaling a factor for the sub-field weights which is used to vary the amount of small pulses generated during each sub-field.

3. Method according to claim 1, wherein the characteristic value for the power level of a video picture is the average picture power value.

4. Method according to claim 1, wherein the sub-field pre-scaling determines, which digital value is assigned to the video level of 100 IRE.

5. Method according to claim 1, wherein the switching between power level modes corresponding to the characteristic value for the power level of the video picture is controlled with an hysteresis-like switching behaviour.

6. Method according to claim 5, wherein for the hysteresis-like switching control two parallel lines in a power level mode versus picture average power diagram are used and the following rules are applied:

i) when picture average power is increasing, modes with power levels on the top line are chosen;

ii) when picture average power is decreasing, modes with power levels on the bottom line are chosen;

iii) in case the picture average power growth direction changes, the switching to a new power level mode is suppressed until the picture average power level lies on the respective other bottom or top line.

7. Apparatus for power level control in a display device having a plurality of elements corresponding to the colour components of pixels of a picture, wherein a control unit is provided that divides the time duration of a video frame or video field into a plurality of sub-fields during which the luminous elements can be activated for light output with small sustain pulses corresponding to a sub-field code word which is used for brightness control, wherein said apparatus has included a picture power measuring circuit, and a sub-field coding unit and wherein a table of power level modes is stored in the control unit for sub-field coding, wherein the picture power measuring circuit determines a value which is characteristic for the power level of a video picture and the control unit selects a corresponding power level mode for the sub-field coding, wherein upon switching from one power level mode to another the control unit provides sustain pulses with one or both of the following characteristics changed compared to the previous power level mode:

the sustain frequency the sustain pulse slope.

8. Apparatus according to claim 7, wherein the control unit changes the timing for the opening and closing of controllable switches in an energy recovery circuit for driving the display to make a change of the sustain frequency or a change of the sustain pulse slope.

9. Apparatus according to claim 7, wherein the table of power level modes includes a complete set of power level modes for each possible picture power value and the maximum picture power value has assigned a power level mode with the minimum number of sustain pulses and the maximum number of sub-fields and wherein in the remaining power level modes the number of sustain pulses increases step by step, wherein the number of sustain pulses is calculated according to a formula in dependence of the picture power value, and a power level mode has assigned the next lower number of sub-fields if the resulting sustain frequency exceeds a predetermined range of stable frequencies.

10. Apparatus according to claim 7, wherein the table of power level modes includes a reduced set of basic power level modes and if for a given power level value no distinct power level mode is available in the table the control unit selects the next neighbouring basic mode with a slightly higher sustain pulse number, wherein the number of sustain pulses is calculated according to a formula in dependence of the picture power value, and a correction of the input video data is made in a pre-scaling unit.

11. Apparatus according to claim 9, wherein the formula for calculating the number of sustain pulses $N_{sus}$ for a given picture power value PL is:

$$N_{sus} = \frac{\sqrt{PL_{\max}}}{\sqrt{PL}} \times N_{\min},$$

wherein $N_{min}$ is the minimum number of sustain pulses according to the maximum allowed power consumption of the panel in case of displaying a full white picture and $PL_{max}$ is the maximum possible power level value corresponding to a full white picture.

12. Apparatus according to claim 10, wherein the correction factor is the quotient between the nominal number of sustain pulses corresponding to the measured picture power value and the number of sustain pulses of the selected neighbouring basic power level mode.

13. Apparatus according to claim 7, wherein the control unit follows a hysteresis curve for power level mode switching control.

14. Apparatus according to claim 7, wherein it is integrated in a display device, in particular plasma display device.

* * * * *